US011313210B2

(12) United States Patent
Al Jawad et al.

(10) Patent No.: US 11,313,210 B2
(45) Date of Patent: Apr. 26, 2022

(54) METHOD OF ENHANCED OIL RECOVERY USING AN OIL HEATING DEVICE

(71) Applicant: KING FAHD UNIVERSITY OF PETROLEUM AND MINERALS, Dhahran (SA)

(72) Inventors: Murtada Al Jawad, Dhahran (SA); Saad Alafnan, Dhahran (SA); Sidqi Abu-Khamsin, Dhahran (SA)

(73) Assignee: KING FAHD UNIVERSITY OF PETROLEUM AND MINERALS, Dhahran (SA)

( * ) Notice: Subject to any disclaimer, the term of this patent is extended or adjusted under 35 U.S.C. 154(b) by 0 days.

(21) Appl. No.: 16/826,936

(22) Filed: Mar. 23, 2020

(65) Prior Publication Data

US 2021/0293125 A1 Sep. 23, 2021

(51) Int. Cl.

| | |
|---|---|
| ***E21B 43/24*** | (2006.01) |
| ***E21B 21/08*** | (2006.01) |
| ***E21B 47/07*** | (2012.01) |

(52) U.S. Cl.

CPC ..... *E21B 43/2401* (2013.01); *E21B 21/08* (2013.01); *E21B 47/07* (2020.05)

(58) Field of Classification Search

CPC ..... E21B 43/2401; E21B 47/07; E21B 21/08
See application file for complete search history.

(56) References Cited

U.S. PATENT DOCUMENTS

| | | | | |
|---|---|---|---|---|
| 2,632,836 | A | 3/1953 | Ackley | |
| 2,703,621 | A | 3/1955 | Ford | |
| 5,586,213 | A | 12/1996 | Bridges et al. | |
| 6,353,706 | B1 | 3/2002 | Bridges | |
| 7,165,607 | B2 | 1/2007 | La Rovere et al. | |
| 2009/0260824 | A1* | 10/2009 | Burns | E21B 19/08 166/302 |
| 2014/0246193 | A1* | 9/2014 | Wollen | E21B 47/07 166/252.1 |
| 2016/0053596 | A1 | 2/2016 | Rey | |

FOREIGN PATENT DOCUMENTS

| | | | |
|---|---|---|---|
| CN | 206545502 | U | 10/2017 |

OTHER PUBLICATIONS

S. Ucan, et al., "Electrical Wellbore Heating in Environmentally Sensitive Llancanelo Field, Argentina", Society of Petroleum Engineers, SPE Latin America and Caribbean Petroleum Engineering Conference, May 21-23, 2014, 12 pages (Abstract only).

Greg Mcqueen, et al., "Enhanced oil recovery of shallow wells with heavy oil: A case study in electro thermal heating of California oil wells", IEEE Record of Conference Papers—Industry Applications Society 56$^{th}$ Annual Petroleum and Chemical Industry Conference, https://ieeexplore.ieee.org/document/5297168, Sep. 14-16, 2009, 2 pages (Abstract only).

* cited by examiner

*Primary Examiner* — Dany E Akakpo
(74) *Attorney, Agent, or Firm* — Oblon, McClelland, Maier & Neustadt, L.L.P.

(57) ABSTRACT

A method of enhanced oil recovery of using an oil heating device that is permanently-installed at the end of a production pipe down a wellbore into the pay zone of an oil deposit. The oil heating device contains an array of individually-controlled heating elements controlled by a controller. The oil heating device may also contain a plurality of sensors including array temperature sensors, oil temperature sensors, and oil flow sensors connected to the controller.

20 Claims, 10 Drawing Sheets

Figure 1: Flow chart of the wellbore/reservoir mass and heat transfer model.

METHOD OF ENHANCED OIL RECOVERY USING AN OIL HEATING DEVICE

BACKGROUND OF THE INVENTION

Technical Field

The present invention relates to a method of enhanced oil recovery using an oil heating device and an oil heating device comprising an array of independently-controlled heating elements.

Description of the Related Art

The "background" description provided herein is for the purpose of generally presenting the context of the disclosure. Work of the presently named inventors, to the extent it is described in this background section, as well as aspects of the description which may not otherwise qualify as prior art at the time of filing, are neither expressly or impliedly admitted as prior art against the present invention.

Heavy oil or heavy crude is a highly-viscous mixture of hydrocarbons that cannot be produced commercially under normal reservoir conditions economically. It makes up a large portion of the world's current reserves. Thermal treatment of heavy oil can aid the exploitation of significant portions of oil resources to supply an increasing global demand for energy.

Thermal enhanced oil recovery (EOR) is an active area of research and development. Thermal methods of EOR currently used include hot water flooding, steam injection, and in-situ combustion. High porosity sand formations containing heavy and extra heavy crudes of API less than 20 are considered the most suitable candidates for thermal EOR processes [Conaway, C. F., 1999, The Petroleum Industry: A Nontechnical Guide, 85-86. Tulsa: PennWell Books; Alvarado, V., and Manrique, E., 2010, Energies, 3, 9, 1529-1575; and Santos, R., et. al., 2014, Braz. J. Chem. Eng., 31, 3, 571-590]. The aforementioned techniques rely on heat transfer by injected material or in-situ partial burning of hydrocarbons contained in the formation. They require large capital investments and applications are restricted by some factors including the targeted formation depth, thickness and other logistics.

Traditional thermal enhanced oil recovery techniques including steam injection, in-situ oil combustion, and mining are traditionally used for heavy crudes. Together, this supplies only 3% of the world's oil demand [Kokal, S. and Al-Kaabi, A., 2010, World Petroleum Council: Official Publication, 64-69].

When thermally stimulated, hydrocarbon properties such as density and viscosity change significantly. These changes facilitate the flow of heavy oil in the reservoir and hence increase the oil recovery [Sarapardeh, A., et. al., 2013, SPE Middle East Oil and Gas Show and Conference, Paper No. 164418; Hemmati-Sarapardeh, A., et. al., 2014, Fuel, 116, 39-48; and Bera, A., & Babadagli, T., 2015, Appl. Energy, 151, 206-226]. Increasing the temperature of heavy crudes from typical reservoir temperature to 200-300° F. can reduce the viscosity of oil by orders of magnitude. Such reduced viscosity enhances inflow performance significantly [Prats, M., 1982, Thermal Recovery, SPE Monograph Series, Vol. 7, SPE of AIME].

Another family of thermal EOR methods utilizes electric current to directly heat the geologic formations in which the heavy oil is contained. Those include resistive, radiofrequency, and inductive heating [Ali, S. M., & Bayestehparvin, B., 2013, SPE Canada Heavy Oil Technical Conference]. While the impact of these types of thermal EOR methods on incremental recovery is not as significant, they have certain advantages over traditional methods. Thermal EOR using electric current provides means of enhancing the productivity for situations where capital investments are unattainable or technical implementation of typical thermal EOR is impractical (e.g. offshore wells). Resistive heating employs a potential difference between two wells where one well is acting as an electrode and the other well is a cathode. Resistive heating typically requires some injected liquid, such as water, to improve the heat conduction. The formation enclosed by the two adjacent wells is subject to increase in temperature as electric current flows through it, enhancing oil production [Yuan, J. Y., et. al., 2003, "Wet Electric Heating Process," U.S. Pat. No. 6,631,761]. A similar principle can be applied where a downhole electrical heater is placed to heat hydrocarbons within close vicinity of the well. Compared with steam assisted gravity drainage (SAGD), this process shows reasonable efficiency with lower water to oil production ratio [Maggard, J. B. and Wattenbarger, R. A. 1991, Proc., UNITAR/UNDP 5th International Conference on Heavy Oil and Tar Sands, Caracas, 519-530; Vinsome, K., et. al., 1994, Electrical Heating, Petroleum Society of Canada, doi:10.2118/94-04-04; Faradonbeh, M. R., et. al., Fuel, 186, 68-81; and Bottazzi, F., et. al., 2013, International Petroleum Technology Conference, doi:10.2523/IPTC-16858-Abstract]. Reservoir models and simulation studies have been established to study the feasibility of downhole electrical heating [Rangel-German, E. R., et. al., 2004, J. Pet. Sci. Eng., 45,3-4, 213-231; and Sierra, R., et. al., 2001, Paper SPE 69709, SPE International Thermal Operations and Heavy Oil Symposium]. Laboratory work has also been also conducted to experimentally study resistive heating [Newbold, F. R. & Perkins, T. K. 1978, J. Cdn. Pet. Tech., 17]. The radiofrequency heating approach involves converting electromagnetic waves into thermal energy in the reservoir assisted by some organic solvent injection. This approach has the advantage of reducing water injection and carbon dioxide emissions. The design requirements of downhole equipment and high pressure/high temperature conditions that are required are some limitations [Amba, S., et. al., 1964, J. Can. Pet. Technol., 3, 1, 8-14; Jha, K. N. & Chakma, A., 1999, Heavy-Oil Recovery from Thin Pay Zones by Electromagnetic Heating. Energy Sources, Part A: Recovery, Utilization, and Environmental Effects 21, 1-2, 63-73.; Sahni, A., et. al., 200, SPE/AAPG Western Regional Meeting, SPE Paper No. 62550; Acar, C., et. al., 2007, Proc., 150 Years of the Romanian Petroleum Industry: Tradition and Challenges; Hascakir, B., et. al., 2009, Energy Fuels, 23(12), pp. 6033-6039; Kovaleva, L., et. al., 2010, Energy Fuels, 25, 2, 482-486].

Downhole electric heating by increasing the temperature of heavy oil using a permanently installed heating element can enhance hydrocarbon flow from the reservoir to the wellbore. Moreover, heated hydrocarbons show improved outflow performance from the wellbore to the surface as both viscosity and density are reduced at elevated temperature.

In view of the foregoing, one objective of the present invention is to provide a method for enhanced oil recovery involving heating a portion of a geological formation and oil present therein using an oil heating device. A second objective is to provide an oil heating device comprising an array of independently-controlled heating elements.

BRIEF SUMMARY OF THE INVENTION

According to a first aspect, the present disclosure relates to a method of enhanced oil recovery, the method comprising: heating a portion of a geological formation containing an oil deposit with an oil heating device comprising a permanently-installed array of heating elements disposed at a location of a production pipe disposed in the portion of the geological formation containing the oil deposit, at a temperature sufficient to reduce the viscosity of oil in the oil deposit and flow the oil from the oil deposit into the production pipe; and recovering the oil by transporting the oil from the production pipe to the surface, wherein the permanently-installed array of heating elements comprises individual, independently-controllable heating elements.

In some embodiments, the method further comprises cycling an output state of the oil deposit to a state of not producing, heating the oil while the oil deposit is in the state of not producing, and cycling an output state of the oil deposit to a state of producing.

In some embodiments, the oil heating device further comprises a controller.

In some embodiments, the individual, independently-controllable heating elements are operated to provide the production pipe or the oil deposit a temperature profile that is non-cylindrically symmetrical.

In some embodiments, the individual, independently-controllable heating elements are ohmic heating elements.

In some embodiments, the oil heating device further comprises a plurality of array temperature sensors capable of measuring a temperature profile of the permanently-installed array of heating elements.

In some embodiments, the controller receives input from the plurality of array temperature sensors and adjusts the temperature profile of the permanently-installed array of heating elements based on said input.

In some embodiments, the oil heating device further comprises a plurality of oil temperature sensors capable of measuring a temperature distribution of oil in the production pipe and a plurality of flow sensors capable of measuring an oil flow profile into and along the production pipe.

In some embodiments, the controller receives input from the plurality of oil temperature sensors and plurality of flow sensors and adjusts the temperature profile of the permanently-installed array of heating elements based on said input.

In some embodiments, the controller adjusts the temperature of the permanently-installed array of heating elements to a defined temperature based on an amount of energy used by the permanently-installed array of heating elements and a production metric of the oil deposit.

In some embodiments, the permanently-installed array of heating elements is heated to a temperature of 400 to 700° F.

In some embodiments, the method increases a reservoir productivity index of the oil deposit by 5 to 50% compared to an oil deposit which is not heated.

In some embodiments, a bottomhole pressure required to maintain a production rate of the oil deposit heated according to the method is lowered by 50 to 250 PSI compared to an oil deposit which is not heated.

In some embodiments, the oil deposit in a state of producing produces oil at a rate of 0.05 to 5 STB per day per foot of pay zone thickness.

In some embodiments, the oil is heated while the oil deposit is in the state of not producing for 1 to 100 days.

In some embodiments, the oil heating device uses 25 to 250 kW.

The present disclosure also relates to an oil heating device, comprising a permanently-installed array of heating elements; and a controller, wherein the permanently-installed array of heating elements comprises individual, independently-controllable heating elements controlled by the controller.

In some embodiments, the individual, independently-controllable heating elements are capable of giving the permanently-installed array a temperature profile that is non-cylindrically symmetrical.

In some embodiments, the permanently-installed array of heating elements is capable of being heated to a temperature of 400 to 700° F.

In some embodiments, the oil heating device further comprises a plurality of sensors connected to the controller, the sensors being at least one selected from the group consisting of array temperature sensors, oil temperature sensors, and oil flow sensors.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein:

FIG. 3A-3B show the pressure and temperature characteristics of a reservoir after 2 days of heating, wherein FIG. 3A is the reservoir pressure profile and FIG. 3B is the reservoir temperature profile;

FIG. 4A-4B show the temperature and viscosity profiles of oil in an oil reservoir at different production rates wherein FIG. 4A shows the oil deposit temperature profile, and FIG. 4B shows the viscosity profile of oil in the oil deposit;

FIG. 6A-6B show the temperature of the oil in the oil deposit after heating for 80 days, wherein FIG. 6A shows a contour plot of the oil temperature as a function of distance from the oil heating device, and FIG. 6B shows the temperature increase of the oil at different distances from the oil heating device as function of heating time up to 80 days;

FIG. 8A-8B show the temperature of the oil in the oil deposit, wherein FIG. 8A shows the temperature profile before heating, and FIG. 8B shows the temperature after heating for 10 days at a production rate of 50 STB/day;

FIG. 10A-10C show the properties of the oil in the oil deposit before and after placing the oil heating device, wherein FIG. 10A shows the temperature profile, FIG. 10B shows the viscosity profile, and FIG. 10C shows the density profile;

FIG. 11A-11B show the bottomhole pressure as a function of the production rate at different temperatures, wherein FIG. 11A is for a 4000 ft. wellbore, and FIG. 11B is for a 7900 ft. wellbore;

FIG. 12A-12B show the inflow performance relationship (IPR) and outflow performance relationship (OPR) as a function of production rate before heating (OPR1 and IPR1) and after heating (OPR2 and IPR2), wherein FIG. 12A is for a 4000 ft. wellbore, and FIG. 12B is for a 7900 ft. wellbore.

DETAILED DESCRIPTION OF THE INVENTION

Figure 1:
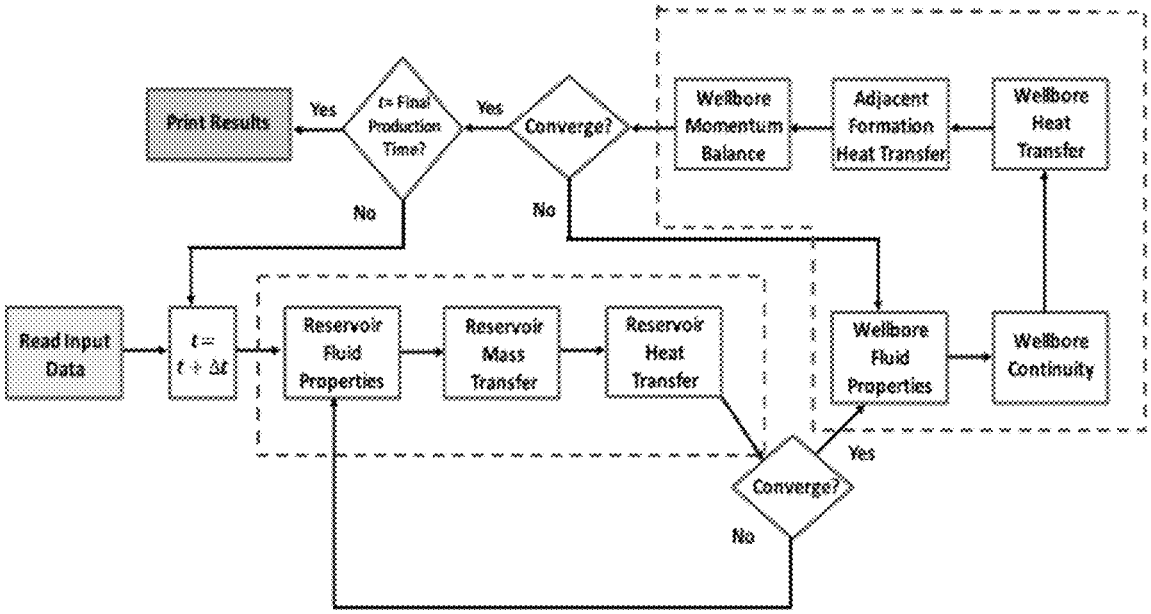
FIG. 1 shows a flowchart of a wellbore and reservoir mass and heat transfer model.

Embodiments of the present disclosure will now be described more fully hereinafter with reference to the accompanying drawings, in which some, but not all embodiments of the disclosure are shown.

The present disclosure will be better understood with reference to the following definitions. As used herein, the words "a" and "an" and the like carry the meaning of "one or more." Within the description of this disclosure, where a numerical limit or range is stated, the endpoints are included unless stated otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

As used herein, the words "about," "approximately," or "substantially similar" may be used when describing magnitude and/or position to indicate that the value and/or position described is within a reasonable expected range of values and/or positions. For example, a numeric value may have a value that is +/−0.1% of the stated value (or range of values), +/−1% of the stated value (or range of values), +/−2% of the stated value (or range of values), +/−5% of the stated value (or range of values), +/−10% of the stated value (or range of values), +/−15% of the stated value (or range of values), or +/−20% of the stated value (or range of values). Within the description of this disclosure, where a numerical limit or range is stated, the endpoints are included unless stated otherwise. Also, all values and subranges within a numerical limit or range are specifically included as if explicitly written out.

As used herein "heavy oil" (also known as "heavy crude") is a type of crude characterized by an API gravity of between 22° to and 10°. While not a strict requirement for the definition, heavy oil typically has a viscosity of greater than 10 cP. Heavy oil also typically has a low kinematic velocity and high solidification point. It is distinct from "extra-heavy oil", which has an API gravity of less than 10°. Heavy oil may contain high levels of asphaltenes and/or petroleum resins. Asphaltenes are molecular substances consisting primarily of carbon, hydrogen, nitrogen, oxygen, and sulfur and typically have molecular masses from 400 to 1500 Da. Petroleum resins are thermoplastic hydrocarbon resins having molecular masses from 500 to 5000 Da.

As used herein, "oil deposit" refers to a subsurface pool of oil contained within porous or fractured geological formations. The term typically refers to only pools of oil which contain one or more pay zones.

As used herein, "wellbore completions" refers to the set of downhole tubulars and equipment required to enable safe and efficient production from an oil or gas well.

As used herein, "pay zone" refers to an oil deposit or portion of an oil deposit that contains oil in an exploitable quantity and which may be exploited economically. A pay zone may exclude portions of an oil deposit which contain too little oil to economically exploit or which include oil that is not economical to exploit due to inaccessibility, properties of the oil contained therein, or some other reason.

As used herein, "producing" refers to an oil deposit or pay zone in an oil deposit from which oil in the process of being drained, typically by flowing or pumping the oil out of the deposit through a production pipe. An oil deposit or pay zone from which there is no active flow is typically referred to as "not producing".

According to a first aspect, the present disclosure relates to a method of enhanced oil recovery. This method comprises heating a portion of a geological formation containing an oil deposit with an oil heating device. In some embodiments, the oil heating device comprises a permanently-installed array of heating elements placed on an end, at different depths and/or at different lateral distances from a well bore of a production pipe down a wellbore into a pay zone of the oil deposit and recovering oil when the oil deposit is in a state of producing. In some embodiments, the geological formation containing an oil deposit to be heated by the method comes into direct contact with a portion of the oil heating device configured to contact the geological formation. In some embodiments, the portion of the oil heating device configured to contact the geological formation comprises the heating elements. In some embodiments, the portion of the oil heating device configured to contact the geological formation comprises a protective covering placed around one or more of the heating elements. In some embodiments, the protective covering prevents the geological formation from contacting the heating elements directly. In some embodiments, the protective covering is heated by the heating elements and acts as a heat transfer material to transfer heat from the heating elements to the geological formation. Examples of heat transfer materials are metals such as steel, aluminum, and copper, and ceramics such as molybdenum disilicide, silicon carbide, barium titanate, and aluminum nitride. In some embodiments, the heat transferred to the geological formation is then transferred to the oil. In some embodiments, the oil does not come into direct contact with any portion of the oil heating device.

In some embodiments, the oil to be heated by the method comes into direct contact with a portion of the oil heating device configured to contact oil. In some embodiments, the portion of the oil heating device configured to contact oil comprises the heating elements. In some embodiments, the portion of the oil heating device configured to contact oil comprises a protective covering placed around one or more heating elements. In some embodiments, the protective covering prevents oil from contacting the heating elements directly. In some embodiments, the protective covering is heated by the heating elements and acts as a heat transfer material to transfer heat from the heating elements to the oil. Examples of heat transfer materials include heat transfer materials as described above. In some embodiments, the oil does not contact the oil heating device.

In some embodiments, the oil heating device also heats a portion of the wellbore that is not the geological formation. Examples of such portions include, but are not limited to, wellbore casings, wellbore cement, and wellbore completions. In some embodiments, the oil heating device also heats a portion of the production pipe.

The method preferably does not involve heating the oil or the geological formation by combustion of the oil or a component of the oil within the geological formation, production pipe, or other wellbore. The method preferably does not involve the use of a heater well. The method preferably does not involve heating the oil or the geological formation by the introduction of steam or other fluid having a temperature greater than the temperature of the oil or geological formation. The method also preferably does not involve heating the oil or the oil deposit by the passing of an electric current through the oil deposit or a fluid in the geological formation containing the oil deposit.

The heating may be accomplished through the use of an oil heating device comprising a permanently-installed array of heating elements and a controller. The permanently-installed array of heating elements comprises individual, independently-controllable heating elements controlled by the controller. In some embodiments, the individual, independently-controllable heating elements are ohmic heating elements. Ohmic heating elements, also known as resistive heating elements or joule heating elements, operate by passing an electric current through a conductor. The temperature reached by an individual element is controlled by adjusting the parameters of the electric current passing through the element. In some embodiments, the permanently-installed array of heating elements is capable of being heated to a temperature of 400 to 700° F., preferably 425 to 675° F., preferably 450 to 650° F., preferably 475 to 625° F., preferably 500 to 600° F., preferably 515 to 575° F., preferably 525 to 550° F., preferably 530 to 540° F.

As used herein, "permanently-installed" means in place for an entire production lifetime of an oil well. While a permanently-installed tool or device may be temporarily removed for purposes such as maintenance, it should be returned to place after said maintenance is performed. Preferably, the oil well is placed in a state of not producing during said maintenance. The permanently-installed array of heating elements is preferably in place before production begins and when production is permanently ceased. In some embodiments, the permanently-installed array of heating elements is not permanently removed from the wellbore. In some embodiments, the permanently-installed array of heating elements or a portion of the array is temporarily removed for purposes such as repair, testing, or other maintenance, but the array is preferably replaced after such removal. In some embodiments, the permanently-installed array of heating elements is installed during wellbore completion. In some embodiments, the permanently-installed array of heating elements is removed during well abandonment or decommissioning. In some embodiments, the permanently-installed array of heating elements is not removed during well abandonment or decommissioning. In some embodiments, the permanently-installed array of heating elements is installed outside of a wellbore casing. In such embodiments, the permanently-installed array of heating elements may be cemented into place. In embodiments where the permanently-installed array of heating elements is installed outside of the wellbore casing, the permanently-installed array of heating elements may be in contact with or attached to the wellbore casing. In some embodiments, the permanently-installed array of heating elements may be installed inside the wellbore casing. In such embodiments, the permanently-installed array of heating elements may be in contact with or attached to the wellbore casing. In alternative embodiments, the permanently-installed array of heating elements is attached to a wellbore tubular inside of the wellbore casing but not in contact with the wellbore casing. In some embodiments, the permanently-installed array of heating elements is installed in a portion of the wellbore without a wellbore casing. In such embodiments, the permanently-installed array of heating elements may be disposed upon or attached to the geological formation. In some embodiments, the permanently-installed array of heating elements may be attached to a separate portion of the wellbore in the uncased portion such as a sand screen or gravel pack. In some embodiments, the permanently-installed array of heating elements is disposed upon or attached to a wellbore annulus. Preferably, the permanently-installed array of heating elements is not attached to a portion of wellbore or wellbore equipment which moves, such as a sucker rod, plunger, or pumpjack.

In one embodiment of the present disclosure the heating elements are permanently held in place with a packer that is placed at a desired location inside tubing that is cemented into the wellbore. The packer preferably has one or more expanding components that form a seal inside or outside of production tubing to hold in place heating elements and thereby result in a permanent installment. The packer may be activated through a sliding sleeve mechanism or by wire line. In other embodiments the heating elements are directly formed in the production tubing which is preferably cemented into the wellbore. In this embodiment, the heating elements may be one or more resistive elements on the surface of an interior or exterior portion of the production tubing that is in contact with the wellbore and the corresponding geological formation.

In some embodiments, the permanently-installed array of heating elements is installed in a vertical wellbore. In alternative embodiments, the permanently-installed array of heating elements is installed in a lateral wellbore. In some embodiments, the permanently-installed array of heating elements has a length greater than the extent of the pay zone in which the permanently-installed array of heating elements operates. In alternative embodiments, the permanently-installed array of heating elements has a length less than the extent of the pay zone in which the permanently-installed array of heating elements operates. In some embodiments, only a single permanently-installed array of heating elements is used. In some embodiments, an oil heating device contains only one permanently-installed array of heating elements. In alternative embodiments, an oil heating device contains multiple permanently-installed arrays of heating elements. In such embodiments, the arrays may be continuous, that is, not separated by a portion of wellbore or wellbore tubular. In some embodiments, the arrays may be discontinuous, that is, separated by a portion of wellbore or wellbore tubular not containing such an array. In some embodiments, multiple oil heating devices may be used. In embodiments with multiple permanently-installed arrays of heating elements, the multiple arrays may be placed adjacent to each other, that is, along the length of the wellbore or wellbore tubular with no separation. In alternative embodiments, the multiple arrays may be separated along the length of the wellbore or wellbore tubular.

In some embodiments, the oil deposit may have more than one pay zone. In such embodiments, one oil heating device may be used. In such embodiments, the single oil heating device may be of any length so long as a portion of the single oil heating device is located in each of the pay zones. Alternatively, more than one oil heating device may be used. In such embodiments, there is no restriction on the number or length of the oil heating devices so long as a portion of at least one permanently-installed array of heating elements of at least one oil heating device is located in each pay zone. In embodiments in which more than one oil heating device is used, the oil heating devices may be operated independently. In embodiments in which more than one array is used, the arrays may be operated independently. In such embodiments, the arrays may be operated independently by a single controller. In alternative embodiments, the arrays may be operated independently by different controllers.

In some embodiments, the oil heating device may fit inside a wellbore, that is, it has an exterior width or extent less than 13⅜ inches, preferably less than 9⅝ inches, preferably less than 7 inches, preferably less than 6 inches. In some embodiments, the oil heating device may fit around a wellbore tubular, that is it has an open interior portion that is greater than 2.475 inches, preferably greater than 3 inches, preferably greater than 3.5 inches, preferably greater than 4 inches, preferably greater than 4.08 inches. In some embodiments, the oil heating device is placed at the end of a wellbore tubular and contains an open interior portion that is not greater than 2.475 inches which interfaces to said wellbore tubular without being placed around it. In general, there is no specific limit on the minimum or maximum length of the oil heating device. In some embodiments, the oil heating device has a length less than 4000 ft, preferably less than 3750 ft, preferably less than 3500 ft, preferably less than 3250 ft, preferably less than 3000 ft, preferably less than 2750 ft, preferably less than 2500 ft, preferably less than 2250 ft, preferably less than 2000 ft, preferably less than 1750 ft, preferably less than 1500 ft, preferably less than 1250 ft, preferably less than 1000 ft, preferably less than 750 ft, preferably less than 500 ft, preferably less than 400 ft, preferably less than 300 ft, preferably less than 250 ft.

In some embodiments, the array of heating elements extends the entire length of the oil heating device. In alternative embodiments, the array of heating elements has a length that is less than the length of the oil heating device. In such embodiments, the array of heating elements has a length less than 4000 ft, preferably less than 3750 ft, preferably less than 3500 ft, preferably less than 3250 ft, preferably less than 3000 ft, preferably less than 2750 ft, preferably less than 2500 ft, preferably less than 2250 ft, preferably less than 2000 ft, preferably less than 1750 ft, preferably less than 1500 ft, preferably less than 1250 ft, preferably less than 1000 ft, preferably less than 750 ft, preferably less than 500 ft, preferably less than 400 ft, preferably less than 300 ft, preferably less than 250 ft.

In some embodiments, the individual, independently-controllable heating elements of the array are made of metal, a ceramic semiconductor, a polymer, or some other type of heating element known to those of ordinary skill in the art. The heating elements may be in the form of wires, ribbons, plates, discs, foils, tubes, coils, or the like. Metal heating elements may be formed from metals or metal alloys such as nichrome 80/20 (an alloy comprising 80 wt % nickel and 20 wt % chromium based on a total weight of nichrome alloy), Kanthal (an alloy of iron, chromium, and aluminum), and cupronickel (an alloy of copper and nickel). Ceramic semiconductor heating elements may be formed from semiconducting ceramic materials that display a positive thermal coefficient (PTC) such as bismuth-, lanthanum-, samarium-, antimony-, or niobium-doped barium titanate, aluminum- or chromium-doped vanadium oxide, molybdenum disilicide, and silicon carbide.

In general, the permanently-installed array of heating elements must comprise at least two individual, independently-controllable heating elements. These at least two individual, independently-controllable heating elements should be positioned such that there exists a portion of the array which has, at the same position along the length of the array, a position on the opposite side of the array which contains a different heating element than the aforementioned portion. This geometry of the array is necessary for giving the array the ability to impart a non-cylindrically symmetric heating profile as described below. An alternative way of describing this geometry is that there exists a path at a position along the length of the array around the circumference or perimeter of a wellbore or wellbore tubular about which the heating device is placed, this path passing over more than one heating element. While this geometry requires at least two heating elements, no limit on the maximum number of heating elements exists. One example of such a geometry is having two curved heating elements, the length of which are equal to the length of the array and the width of which are equal to approximately half of a circumference or perimeter of the array, placed on opposing sides of the array. Another example of such a geometry is a grid of small, circular or plate-shaped heating elements placed on the surface of a cylindrical oil heating device. An example of an array which does not satisfy the above requirements is a series of ring-shaped heating elements stacked along the length of the oil heating device. This geometry may allow for a heating profile that differs along the length of the oil heating device but not around the circumference or perimeter of the oil heating device. A path as described above would be required to traverse a portion of the length of this array to pass over more than one heating element and thus fail the requirement that the path be at a certain position along the length.

In some embodiments, the individual, independently-controllable heating elements have a length of 1 mm to 76.2 m (250 ft), preferably 2 mm to 70 m, preferably 1 cm to 65 m, preferably 10 cm to 60 m, preferably 50 cm to 50 m, preferably 1 m to 25 m. In some embodiments, the individual, independently-controllable heating elements have a width of 1 mm to 53.36 cm, preferably 2 mm to 39 cm, preferably 5 mm to 28 cm, preferably 1 cm to 24 cm, preferably 5 cm to 15 cm. In some embodiments, the individual, independently-controllable heating elements are separated along the length of the array by 5 to 100% of the length of the individual, independently-controllable heating elements, preferably 10 to 90%, preferably 25 to 75%, preferably 50% of the length of the individual, independently-controllable heating elements. In some embodiments, the individual, independently-controllable heating elements are separated along a circumference or perimeter of the array by 5 to 100% of the width of the individual, independently-controllable heating elements, preferably 10 to 90%, preferably 25 to 75%, preferably 50% of the width of the individual, independently-controllable heating elements. In some embodiments, the individual, independently-controllable heating elements are spaced along the length of the array in a uniform manner, that is, the spacing between individual, independently-controllable heating elements is same for all individual, independently-controllable heating elements along the length of the array of heating elements. In alternative embodiments, the individual, independently-controllable heating elements are not spaced along the length of the array in a uniform manner. In such embodiments, there may be portions of the array in which the spacing between adjacent individual, independently-controllable heating elements along the length of the array is made larger. Such larger spacings may be left to allow oil to enter the interior of the array or production pipe. Such larger spacings may have additional equipment placed such as tubes that allow oil to flow into the interior of the array or production pipe without contacting the individual, independently-controllable heating elements. In some embodiments, the individual, independently-controllable heating elements are spaced along the circumference or perimeter of the array in a uniform manner, that is, the spacing between individual, independently-controllable heating elements is same for all individual, independently-controllable heating elements along the circumference or perimeter of the array of heating elements. In alternative embodiments, the individual, independently-controllable heating elements are not spaced along the circumference or perimeter of the array in a uniform manner. In such embodiments, there may be portions of the array in which the spacing between adjacent individual, independently-controllable heating elements along the circumference or perimeter of the array is made larger. Such larger spacings may be left to allow oil to enter the interior of the array or production pipe. Such larger spacings may have additional equipment placed such as tubes that allow oil to flow into the interior of the array or production pipe without contacting the individual, independently-controllable heating elements.

In some embodiments, the operation of the individual, independently-controllable heating elements is controlled by the controller. In some embodiments, the individual, independently-controllable heating elements are operated to provide the production pipe, wellbore, or the oil deposit a temperature profile that is non-cylindrically symmetrical. In some embodiments, this non-cylindrically symmetrical temperature profile is capable of giving the oil in the oil deposit a temperature profile that is non-cylindrically symmetrical about the wellbore. In alternative embodiments, this non-cylindrically symmetrical temperature profile is capable of giving the oil in the deposit which has a non-cylindrically symmetrical profile about the wellbore while it is in the deposit a temperature profile which is cylindrically symmetrical inside the wellbore or into and along a production pipe after contacting the oil heating device. In some embodiments, the non-cylindrically symmetrical temperature profile is capable of being dynamically adjusted such that a pressure profile of the bottomhole pressure is cylindrically symmetrical about the wellbore. Providing pressure and temperature profiles that are cylindrically symmetrical about the wellbore may be advantageous for certain characteristics of the operation of an oil well. Examples of such characteristics are safety, maintenance costs, maintenance time, geological formation integrity, and production rate.

In some embodiments, the controller is placed in the portion of the oil heating device that is placed down a wellbore. In some embodiments, the controller is not placed down the wellbore, but is connected to the array of heating elements which is placed down the wellbore.

In some embodiments, the oil heating device further comprises a plurality of sensors connected to the controller, the sensors being at least one selected from the group consisting of array temperature sensors, oil temperature sensors, and oil flow sensors.

In some embodiments, the plurality of sensors comprises a plurality of array temperature sensors capable of measuring a temperature profile of the permanently-installed array of heating elements. In some embodiments, the controller receives input from the plurality of array temperature sensors and adjusts the temperature profile of the permanently-installed array of heating elements based on said input.

In some embodiments, the oil heating device further comprises a plurality of oil temperature sensors capable of measuring a temperature distribution of oil in the production pipe and a plurality of flow sensors capable of measuring an oil flow profile into and along the production pipe. In some embodiments, the controller receives input from the plurality of oil temperature sensors and plurality of flow sensors and adjusts the temperature profile of the permanently-installed array of heating elements based on said input.

In some embodiments, the temperature of the permanently-installed array of heating elements is adjusted by the controller to a temperature based on a production metric of the oil deposit, such as required bottomhole pressure, productivity index, or production rate, and an amount of energy used by the permanently-installed array of heating elements. In some embodiments, the oil heating device uses 25 to 250 kW, preferably 30 to 225 kW, preferably 40 to 200 kW, preferably 50 to 175 kW, preferably 60 to 150 kW, preferably 70 to 125 kW, preferably 75 to 100 kW, preferably 80 to 90 kW.

In some embodiments, the method further comprises cycling an output state of the oil deposit to a state of not producing, heating the oil while the oil deposit is in the state of not producing, and cycling an output state of the oil deposit to a state of producing. A period of time where the oil deposit is being heated in the state of not producing is referred to as a "shut-in period". In some embodiments, the shut-in period lasts from 1 to 100 days, preferably 5 to 98 days, preferably 10 to 96 days, preferably 15 to 94 days, preferably 20 to 92 days, preferably 25 to 90 days, preferably 30 to 88 days, preferably 35 to 86 days, preferably 40 to 84 days, preferably 45 to 82 days, preferably 50 to 80 days. In some embodiments, the shut-in period increases the temperature of oil in the oil deposit to a temperature at the end of the shut-in period higher than the temperature reached by heating the oil for an equivalent amount of time of the oil deposit being in a state of producing (i.e. without the shut-in period). In some embodiments, the aforementioned temperature of oil in the oil deposit is a maximum temperature of oil in the oil deposit, an average temperature of oil at a given distance from the oil heating device, or both.

The heating of the oil reduces the density and viscosity of the oil compared to oil not heated by the method. The reduction in density and viscosity provide changes to the operation of a method of oil recovery used to recover the oil from the oil deposit. These changes due to reduced density and viscosity may be advantageous for the method used to recover the oil from the oil deposit. These advantages may be in the form of an increased productivity index or production rate or reduced operational requirements such as bottomhole pressure.

In some embodiments, the method increases a reservoir productivity index of the oil deposit by 5 to 50%, preferably 6 to 49%, preferably 7 to 48%, preferably 8 to 47%, preferably 9 to 46%, preferably 10 to 45%, preferably 11 to 44%, preferably 12 to 43%, preferably 13 to 42%, preferably 14 to 41%, preferably 15 to 40% compared to an oil deposit which is not heated. The reservoir productivity index is the ratio of the production rate to the pressure difference between the average oil deposit reservoir pressure and the bottomhole pressure. As the productivity index is a quantity defined only for a well in a state of producing, this bottomhole pressure is a flowing bottomhole pressure comprising contributions from the depth of the bottomhole and fluid friction of the flowing oil. In some embodiments, the increase in the productivity index is a result of an increase in the production rate, a decrease in the bottomhole pressure, or both.

In some embodiments, a bottomhole pressure required to maintain a production rate of the oil deposit heated according to the method is lowered by 50 to 250 PSI, preferably 75 to 240 PSI, preferably 100 to 230 PSI, preferably 125 to 220 PSI, preferably 150 to 210 PSI, preferably 175 to 200 PSI compared to an oil deposit which is not heated. This bottomhole pressure may be the same as the flowing bottomhole pressure as described above. In some embodiments, the reduction in the required bottomhole pressure is a result of the heated oil having an altered fluid friction component of the flowing bottomhole pressure compared to oil not heated. In some embodiments, the altered fluid friction component is result of the heated oil having a lower density, lower viscosity, or both.

In some embodiments, the permanently-installed array of heating elements is heated to a temperature of 400 to 700° F., preferably 425 to 675° F., preferably 450 to 650° F., preferably 475 to 625° F., preferably 500 to 600° F., preferably 515 to 575° F., preferably 525 to 550° F., preferably 530 to 540° F. In some embodiments, the maximum temperature of oil in the oil deposit is the same as the temperature of the permanently-installed array of heating elements. In some embodiments, the maximum temperature of oil in the oil deposit occurs at a distance of less than 15 ft, preferably less than 12.5 ft, preferably less than 10 ft, preferably less than 7.5 ft, preferably less than 5 ft from the permanently-installed array of heating elements measured in a direction perpendicular to the direction of the wellbore.

In order to achieve the aforementioned enhancements in oil recovery, the oil is preferably flowed through, past, or around the oil heating device slowly enough for the temperature of the oil to increase sufficiently to achieve the enhancements. In some embodiments, the oil deposit in a state of producing produces oil at a rate of 0.05 to 5 STB, preferably 0.1 to 4.75 STB, preferably 0.15 to 4.5 STB, preferably 0.25 to 4.25 STB, preferably 0.5 to 4 STB, preferably 0.75 to 3.75 STB, preferably 1 to 3.5 STB per day per foot of pay zone thickness.

The present disclosure also relates to an oil heating device comprising a permanently-installed array of heating elements and a controller as described above. The permanently-installed array of heating elements comprises individual, independently-controllable heating elements controlled by the controller as described above. In some embodiments, the individual, independently-controllable heating elements are ohmic heating elements as described above. In some embodiments, the permanently-installed array of heating elements is capable of being heated to a temperature of 400 to 700° F., preferably 425 to 675° F., preferably 450 to 650° F., preferably 475 to 625° F., preferably 500 to 600° F., preferably 515 to 575° F., preferably 525 to 550° F., preferably 530 to 540° F. as described above.

In some embodiments, the individual heating elements of the array are metal, ceramic semiconductor, polymer, or some other type of heating element known to those of ordinary skill in the art as described above. The heating elements may be in the form of wires, ribbons, plates, discs, foils, tubes, coils, or the like as described above.

In some embodiments, the operation of the individual, independently-controllable heating elements is controlled by the controller as described above. In some embodiments, the individual, independently-controllable heating elements are operated to provide the production pipe, wellbore, or the oil deposit a temperature profile that is non-cylindrically symmetrical as described above. In some embodiments, this non-cylindrically symmetrical temperature profile is capable of giving the oil in the oil deposit a temperature profile that is non-cylindrically symmetrical about the wellbore as described above. In alternative embodiments, this non-cylindrically symmetrical temperature profile is capable of giving the oil in the deposit which has a non-cylindrically symmetrical profile about the wellbore while it is in the deposit a temperature profile which is cylindrically symmetrical inside the wellbore or into and along a production pipe after contacting the oil heating device as described above. In some embodiments, the non-cylindrically symmetrical temperature profile is capable of being dynamically adjusted such that a pressure profile of the bottomhole pressure is cylindrically symmetrical about the wellbore as described above.

In some embodiments, the oil heating device further comprises a plurality of sensors connected to the controller, the sensors being at least one selected from the group consisting of array temperature sensors, oil temperature sensors, and oil flow sensors as described above.

In some embodiments, the plurality of sensors comprises a plurality of array temperature sensors capable of measuring a temperature profile of the permanently-installed array of heating elements as described above. In some embodiments, the controller receives input from the plurality of array temperature sensors and adjusts the temperature profile of the permanently-installed array of heating elements based on said input as described above.

In some embodiments, the oil heating device further comprises a plurality of oil temperature sensors capable of measuring a temperature distribution of oil in the production pipe and a plurality of flow sensors capable of measuring an oil flow profile into and along the production pipe as described above. In some embodiments, the controller receives input from the plurality of oil temperature sensors and plurality of flow sensors and adjusts the temperature profile of the permanently-installed array of heating elements based on said input as described above.

In some embodiments, the temperature of the permanently-installed array of heating elements is adjusted by the controller to a temperature based on a production metric of the oil deposit, such as required bottomhole pressure, productivity index, or production rate, and an amount of energy used by the permanently-installed array of heating elements as described above. In some embodiments, the oil heating device uses 25 to 250 kW, preferably 30 to 225 kW, preferably 40 to 200 kW, preferably 50 to 175 kW, preferably 60 to 150 kW, preferably 70 to 125 kW, preferably 75 to 100 kW, preferably 80 to 90 kW as described above.

The examples below are intended to further illustrate protocols for the method of enhanced oil recovery and the design of the oil heating device and are not intended to limit the scope of the claims.

EXAMPLE 1

FIG. 1 shows the flow of the model which starts from reading the input data. Then, the reservoir model is applied by solving the reservoir fluid properties, pressure, and temperature until convergence. The convergence is declared when the change in two consecutive pressure and temperature profiles is negligible. The reservoir model provides the temperature of the reservoir fluids entering the wellbore. Then, the wellbore model is applied by solving the wellbore fluid properties, velocity, temperature, and pressure until convergence. This is done at each time step until reaching the final production time. The mathematical formulas for fluid properties and reservoir/wellbore model are discussed below.

Heavy Oil Fluid Properties

Different correlations were developed for the heavy oil fluid density and viscosity which varies based on the reservoir type. In this work, the heavy oil viscosity is estimated using Beggs and Robinson [Beggs, H. D., & Robinson, J., 1975, Journal of Petroleum technology, 27, 09, 1-140, incorporated herein by reference] method while the density is estimated using Alomair et al., [Alomair, O., et. al., 2016, Journal of Petroleum Exploration and Production Technology, 6, 2, 253-263, incorporated herein by reference] approach.

Wellbore Model

The wellbore model is used to investigate the impact of placing a permanent downhole heat source on the bottom-hole pressure required to support a certain flow rate for a given flowing surface tubing pressure. The model solves for the velocity, fluid properties, temperature, and pressure profiles along the wellbore length.

Figure 2:
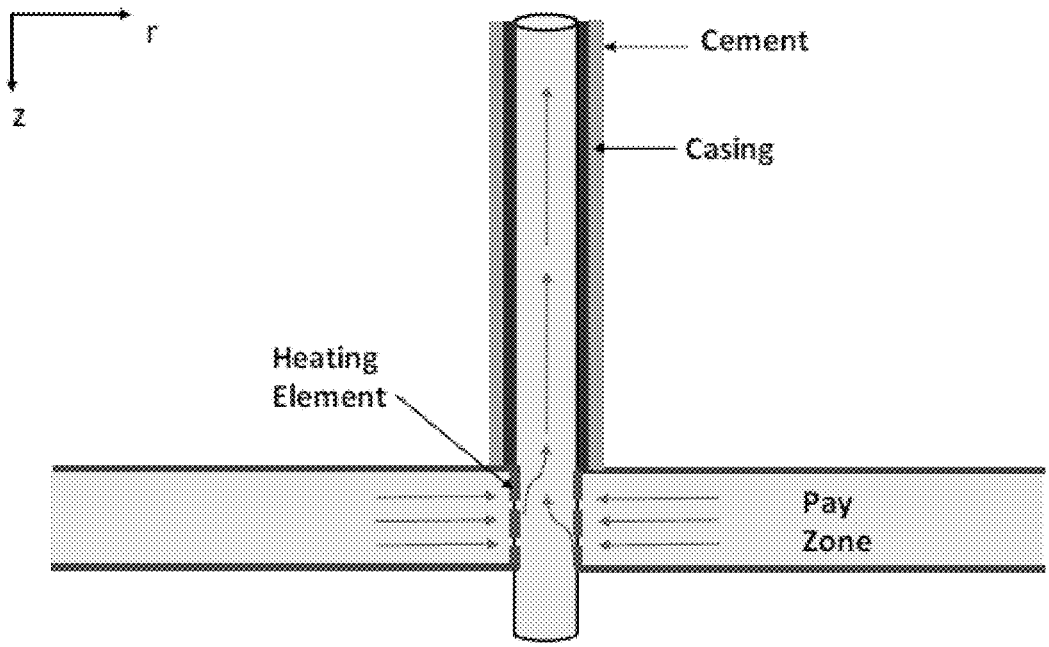
FIG. 2 shows a schematic of an oil heating device placed within a wellbore and a subterranean oil reservoir system.

The velocity profile can be obtained from the mass balance over a section of the wellbore shown in FIG. 2. The wellbore continuity equation can be written as:

$$\frac{\partial \rho_f}{\partial t} = \frac{2\gamma}{R_w}\rho_f v_{L,p} - \frac{\partial(\rho_f v_z)}{\partial z} \tag{1}$$

where $\rho_f$ is the fluid density, $R_w$ is the inner casing or tubing radius, t is time, γ is the wellbore open ratio, $v_{Lp}$ is the produced fluids velocity, and z is the direction along the wellbore length. The first term in continuity equation accounts for the fluid density change, the second term indicates the fluid convection from the reservoir to the wellbore, and the last term is the fluid convection inside the wellbore. After obtaining the velocity profile, the temperature profile can be obtained from solving the thermal energy balance equation which can be written as:

$$\rho_f \hat{C}p_f\left(\frac{\partial T_{wb}}{\partial t} + v_z\frac{\partial T_{wb}}{\partial z} + \frac{2\gamma}{R_w}v_{L,p}(T_{wb} - T_{r|B})\right) = \frac{2(1-\gamma)U}{R_w}(T_{r|B} - T_{wb}) \tag{2}$$

where $\hat{C}_{pf}$ is the fluid's specific heat capacity, $T_{wb}$ is the wellbore temperature, U is the overall heat transfer coefficient between the wellbore and formation in the non-heated section, and $T_{r|B}$ is the temperature at the wellbore/formation boundary. The overall heat transfer coefficient can be estimated through Hasan and Kabir [Hasan, A. R., and C. S. Kabir, 2012 Journal of Petroleum Science and Engineering, 86, 127-136, incorporated herein by reference] approach. The first term in the thermal energy balance equation represents the heat accumulation, the second term is the heat convection along the wellbore's length, the third term denotes heat convection from the formation produced fluids, and the last term represents the heat conducted from the formation. The last term in the above equation is modified for the heated section of the wellbore where the element is placed (see FIG. 2). The equation can be written as:

$$\rho_f \hat{C}p_f\left(\frac{\partial T_{wb}}{\partial t} + v_z\frac{\partial T_{wb}}{\partial z} + \frac{2\gamma}{R_w}v_{L,p}(T_{wb} - T_{r|B})\right) = \frac{2(1-\gamma)h}{R_w}(T_e - T_{wb}) \tag{3}$$

where h is the heat transfer coefficient and Te is the heated element temperature.

Solving the above equation requires knowledge of the formation temperatures. An iterative procedure is used to solve the complete system. The geothermal temperature is employed to initialize the model (i.e., the initial condition) and the fluid temperature leaving the reservoir will be used as boundary condition for the wellbore model. The wellbore temperature model is then coupled with the radial reservoir temperature conduction model which is written as:

$$\overline{\rho\hat{C}p}\frac{\partial T_r}{\partial t} = \frac{1}{r}\frac{\partial}{\partial r}\left(r\overline{k_e}\frac{\partial T_r}{\partial r}\right) + \overline{k_e}\frac{\partial^2 T_r}{\partial z^2} \tag{4}$$

where $$\overline{\rho\hat{C}p} = \rho_f\hat{C}p_f\varphi + \rho_r\hat{C}p_r(1-\varphi) \tag{5}$$

$$\overline{k_e} = \varphi k_f + (1-\varphi)k_r \tag{6}$$

and where is the effective average reservoir rock and fluid property, $\overline{ke}$ is the effective average thermal conductivity, r is the radial direction away from the wellbore, φ is the formation porosity, and the subscripts f and r represents fluid and rock, respectively. The reservoir and wellbore (i.e., inner boundary condition) are coupled through the following boundary condition:

$$\overline{k_e}\frac{\partial T_r}{\partial r}\bigg|_B = U(T_{r|B} - T_{wb}) \tag{7}$$

where the first term represents the heat condition at the reservoir/wellbore boundary and the second term is the heat flux from the wellbore. Convergence of the two models is declared when the difference between the heat fluxes of the wellbore and reservoir models at the boundary is small. The initial reservoir temperature is used as the outer boundary condition. T The pressure along the wellbore can be obtained by solving the momentum balance written as:

$$\frac{\partial p_{wb}}{\partial z} = \frac{f_m\rho_f}{4R_w}v_z^2 - \frac{\partial(\rho_f v_z)}{\partial z} - \rho_f g\sin\theta \tag{8}$$

where $p_{wb}$ is the wellbore pressure, $f_m$ is the Moody friction factor, g is the gravitational acceleration, and θ is the inclination of the wellbore. The Moody friction factor for laminar flow ($N_{Re}$<2000) is:

$$f_m = 64/N_{Re} \tag{9}$$

where $N_{Re}$ is Reynold number, which is defined as:

$$N_{Re} = \frac{\rho_f d v_z}{\mu} \tag{10}$$

and where μ is the fluid viscosity and d is the inner casing or tubing diameter. For unstable and turbulent flow ($N_{Re}$≥2000), Jain and Swamee method is used to calculate the friction factor as follows:

$$f_m = 4\left[2.28 - 4\log\left(\frac{0.0023}{d} + \frac{21.25}{N_{Re}^{0.9}}\right)\right]^{-2} \tag{11}$$

Reservoir Model

The reservoir model is implemented to investigate the impact of the heat source on improving the reservoir fluids' mobility and eventually productivity. The model consists of the diffusivity equation to solve for the pressure profile and energy balance to obtain the reservoir temperature profile.

Since both fluids' viscosity and density are function of the temperature which varies due to the heat source, the following diffusivity equation which assumes variable fluid properties is solved:

$$\frac{1}{r}\frac{\partial}{\partial r}\left(r\rho_f\frac{k}{\mu}\frac{\partial p}{\partial r}\right)=\frac{\partial(\varphi\rho_f)}{\partial t} \tag{12}$$

where p is the reservoir pressure and k is the permeability. To solve the partial differential equation, the pressure is equated to the initial reservoir pressure before production starts. A constant flow rate is assumed at the inner boundary condition, generating a Neumann boundary:

$$(\nabla p)_{wellbore}=-\frac{q_{sc}B_o\mu}{2\pi r_w h_{pay}k} \tag{13}$$

where $q_{sc}$ is the production rate at standard conditions, $B_o$ is oil formation volume factor, $r_w$ is the wellbore radius, and $h_{pay}$ is the pay zone thickness. No flow outer boundary condition is implemented, which can be written as:

$$n\cdot\nabla p=0 \tag{14}$$

where n is the normal vector to the boundary.

The temperature profile can be solved after obtaining the pressure and velocity distributions. This is done by solving the energy balance equation assuming 1D radial heat transfer [Li, X., & Zhu, D., 2018, SPE Production & Operations, 33, 03, 522-538, SPE-181876-PA]:

$$\overline{\rho\hat{C}p}\frac{\partial T}{\partial t}-\varphi\beta_T T\frac{\partial p}{\partial t}+\rho_f\hat{C}_{pf}\mu\frac{\partial T}{\partial r}=\frac{1}{r}\frac{\partial}{\partial r}\left(\overline{k_e}r\frac{\partial T}{\partial r}\right)+(\beta_T-1)\mu\frac{\partial p}{\partial r} \tag{15}$$

and where $\beta_T$ is the thermal expansion factor. The first two terms of the above equation represent the heat accumulation, the third term represents the heat convection, the fourth term represents the heat conduction, and the last term represents the gas expansion effect. The differential equation is solved by applying initial and boundary conditions. Initially, the temperature everywhere is equal to the reservoir temperature. For the outer boundary, the temperature is assumed to be constant at reservoir temperature. The inner boundary condition can be specified as:

$$\overline{k_e}\frac{\partial T}{\partial r}\bigg|_w=U_1(T_e-T_{r|B}) \tag{16}$$

where w stands for the wellbore and $U_1$ is the overall heat transfer coefficient in the heated section.

EXAMPLE 2

The introduced heating element can improve reservoir fluids' mobility as well as assist fluid lifting in the wellbore. Hence, the study will focus on the temperature and pressure responses of the reservoir/wellbore system before and after placing the element. The wellbore, formation, and fluids properties used in this study are shown in Table 1.

TABLE 1

Input data for the integrated heat and mass transfer model

| Input Data | Si Unit | Field Unit |
|---|---|---|
| Wellbore Properties | | |
| Wellbore radius, $r_w$ | 0.104 m | 0.34 ft |
| Inner casing radius, $R_w$ | 0.0628 m | 2.475 inch |
| Overall heat transfer coefficient, U | 0.1 kJ/(s · m² · ° C.) | 0.00488 Btu/(hr · ft² · ° F.) |
| Heat transfer coefficient, h | 60 × 10⁻³ kJ/(s · m² · ° C.) | 2.93 × 10⁻³ Btu/(hr · ft² · ° F.) |
| Ambient temperature, $T_b$ | 25° C. | 77° F. |
| Flowing surface pressure, $P_{tf}$ | 0.69 MPa | 100 psi |
| Wellbore length, L | 1220 m | 4000 ft |
| Reservoir/Formation Properties | | |
| Reservoir initial pressure, $P_R$ | 34.5 MPa | 5000 psi |
| API gravity | 10 | 10 |
| Reservoir temperature, $T_R$ | 80° C. | 176° F. |
| Formation rock density, $\rho_{ma}$ | 2700 kg/m³ | 168.48 $lb_m/ft^3$ |
| Formation specific heat capacity, $c_{pr}$ | 0.879 kJ/(kg · ° C.) | 0.2099 Btu/(lb · ° F.) |
| Formation thermal conductivity, $k_r$ | 1.57 × 10⁻³ kJ/(s · m · ° C.) | 0.907 Btu/(hr · ft · ° F.) |
| Reservoir permeability, k | 4.93 × 10⁻¹⁴ m² | 50 mD |
| Pay zone thickness, $h_{pay}$ | 30.5 m | 100 ft |
| Drainage radius | 30 m | 98.4 ft |
| Formation porosity | 0.1 | 0.1 |
| Initial water saturation | 0.1 | 0.1 |
| General Reservoir Fluid Properties | | |
| Heat capacity, $c_{pf}$ | 2.2 kJ/(kg · ° C.) | 0.525 Btu/($lb_m$ . ° F.) |
| Thermal conductivity, $k_f$ | 1.2 × 10⁻⁴ kJ/(s · m · ° C.) | 0.069 Btu/(hr · ft · ° F.) |

Reservoir

Figure 3A:
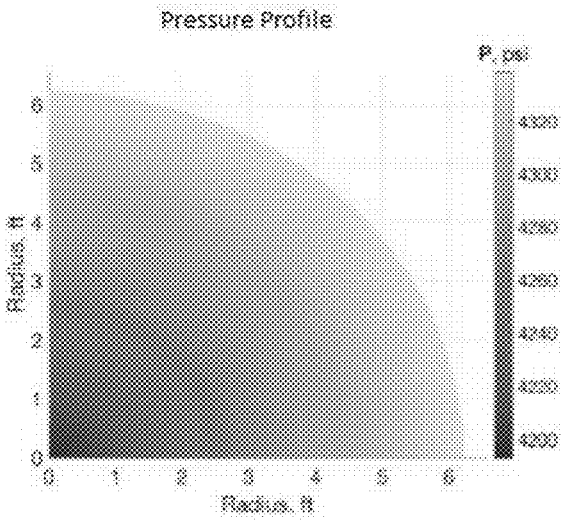
Figure 3B:
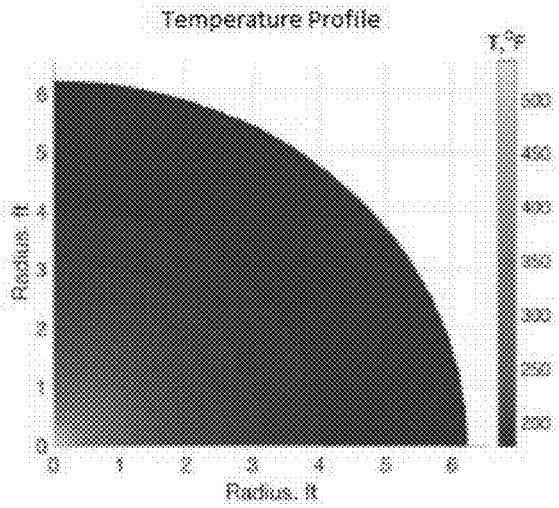

The reservoir temperature evolves because of the heat conduction which acts against the flow direction. Typical pressure and temperature profiles of a reservoir under production after placing the heating element are shown in FIG. 3A-3B. The simulation, in this case, was for 50 STB/day production rate and an element temperature of 536° F. Only a small section of the reservoir is shown as the temperature propagation is limited to the near wellbore region (see FIG. 3B). The temperature profile presented was at steady state while the pressure was at pseudo-steady state. As production continues, the pressure profile keeps changing, however, no change was observed for temperature.

Figure 4A:
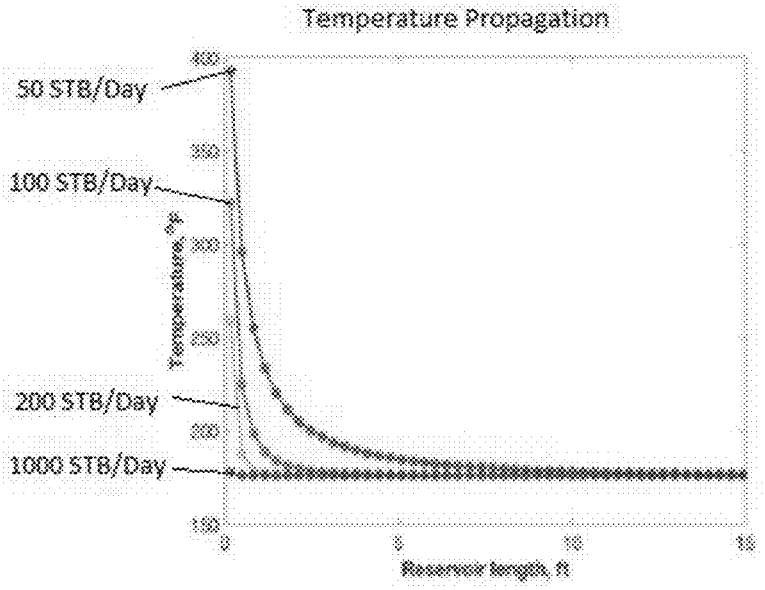
Figure 4B:
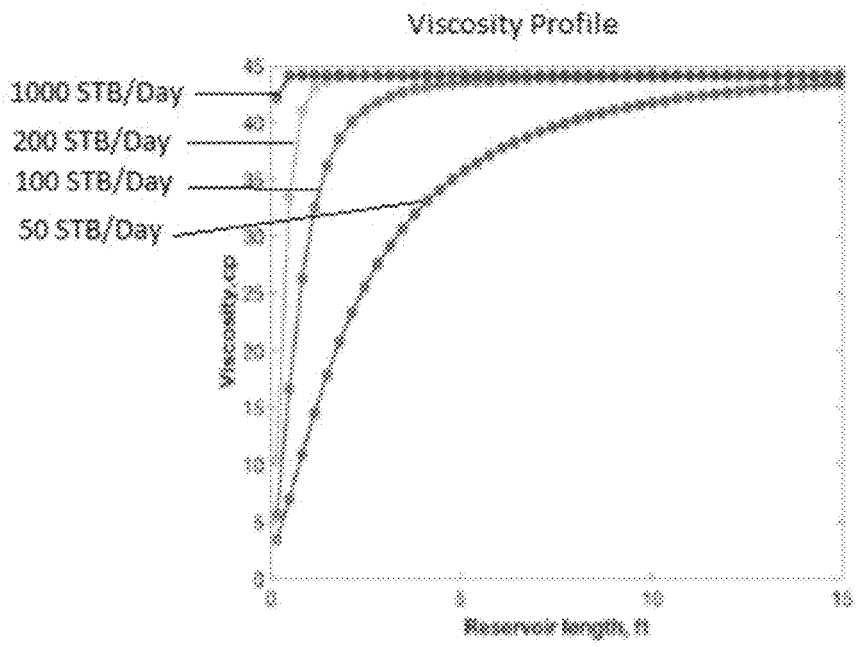

The heat propagation of the heating element is a strong function of the production rate. For all the cases presented in FIG. 4A, no heat propagation is observed beyond 10-15 ft of reservoir radius. It can be also noticed that the higher the flow rate, the lower the heat propagation and temperature magnitudes which were caused by the convection dominated heat transfer. One may notice that the reservoir fluids entering the wellbore did not reach the element temperature which was 536° F. When the production rate is 1000 STB/day, no gain in reservoir fluids temperature is observed and hence heating elements are not applicable for such high production rates. This production is assumed to be generated from a 100 ft thick pay zone. If the 1000 STB/day was produced from a 1000 ft pay zone, as it could occur in a horizontal wellbore, the temperature profile may behave similar to the 100 STB/day case. FIG. 4B shows the corresponding viscosity profile at different production rates. It can be observed that the lower the production rate, the better the mobility achieved due to the higher reduction in viscosity.

Figure 5:
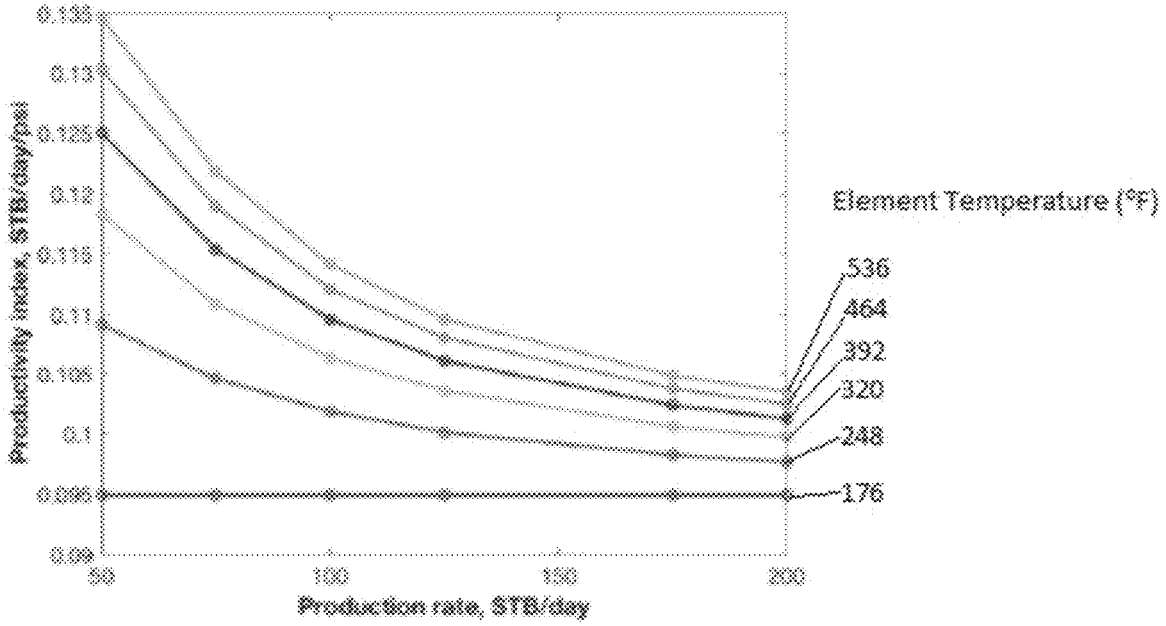
FIG. 5 shows the oil deposit productivity index at different heating element temperatures.

Assessing heating element viability can be achieved through studying the reservoir productivity index at pseudo-steady state, J, which can be defined as:

$$J = \frac{q}{\bar{P} - P_{wf}} \quad (17)$$

where q is the production rate, P is the average reservoir pressure, and $P_{wf}$ is the bottomhole flowing pressure. FIG. 5 shows the productivity index as a function of the production rate at different heating element temperatures. When no heating is considered (176° F.), the productivity index did not change with the increase in production rate. Once the element is placed, the productivity index declines with the increase in production rate as the heat did not propagate as efficiently inside the reservoir. Notice that the improvement in productivity index can be as large as 42% at 50 STB/day and as low as 8% at 200 STB/day and diminishes to zero at 1000 STB/day.

Figure 6A:
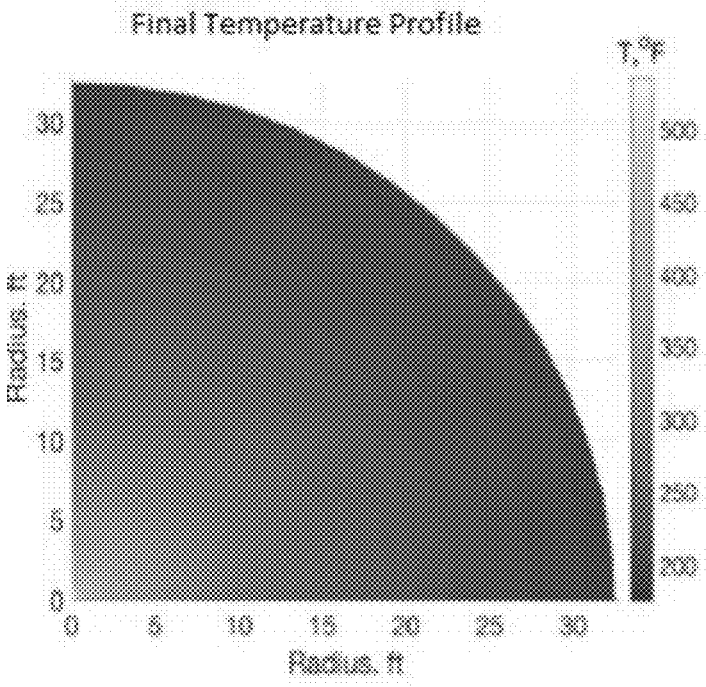
Figure 6B:
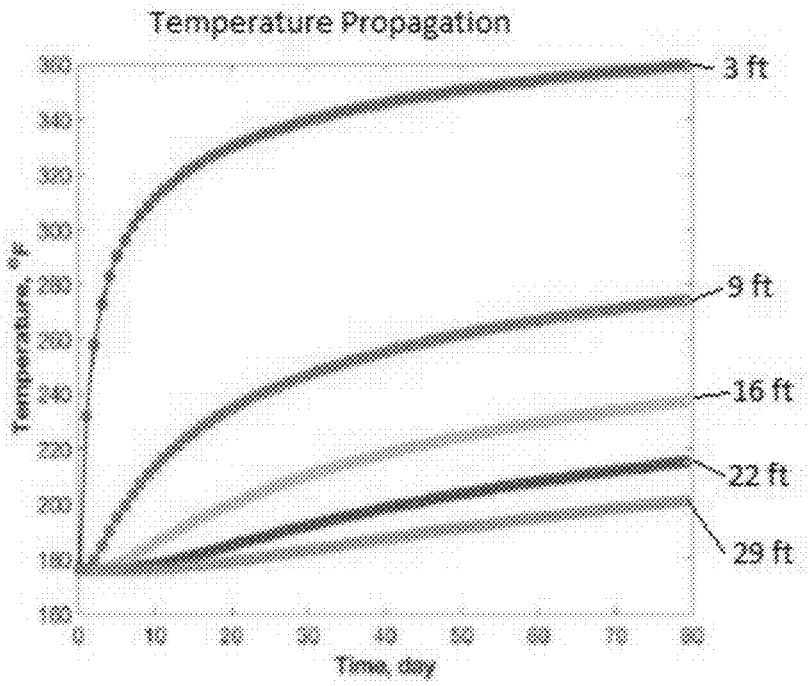

For a reservoir that may not produce naturally due to the fluid's high viscosity, cycles of shut-in and production could be viable. Theoretically speaking, heat propagation can reach to the reservoir boundary through heat conduction assuming no flow condition if enough time is given. FIG. 6A shows the final temperature profile after 80 days of shut-in where heat propagation reached more than 30 ft. FIG. 6B shows the temperature evolution at different locations inside the reservoir during the 80 days. It can be observed that the closer a reservoir location to the heating element, the faster and sharper the increase in the temperature profile. For instance, the heating at 3 ft radius from the wellbore was efficient during the first 10 days where the increase in temperature was much slower afterward.

Figure 7:
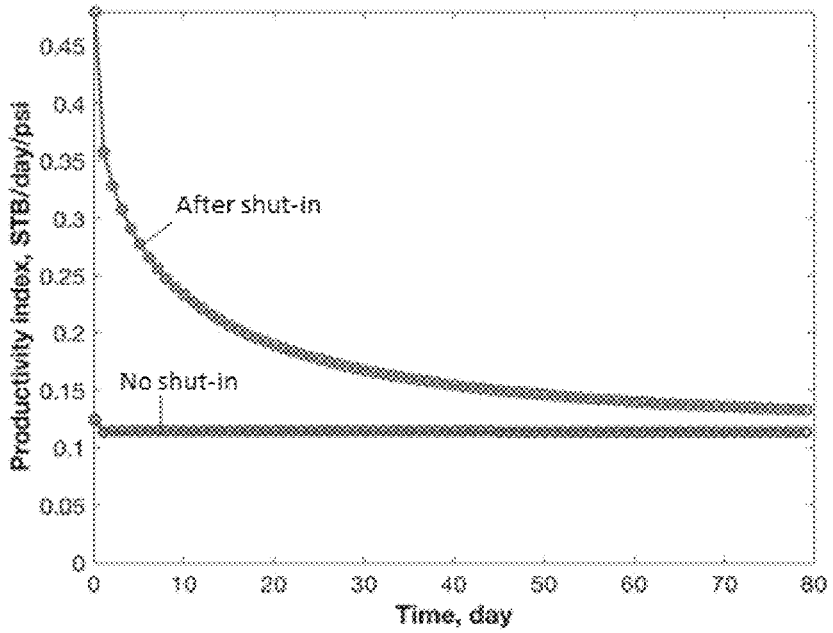
FIG. 7 shows the productivity index of a well with no shut-in period and with an 80-day shut in as a function of time after the end of the shut-in period.

FIG. 7 shows a scenario of 80 days production after a similar period of shut-in and another case where no shut-in period preceded production. It can be observed that the productivity of the first scenario is almost 4 times greater than the second at the initial time; however, the productivity declined to reach that of the second case after 80 days of production as the temperature is retaining the initial geothermal one. In both cases, the element temperature was assumed to be around 536° F. while the production rate was 200 STB/day. The case presented below may not be ideal for cyclic production as the reservoir flows naturally. Nevertheless, it could be suitable for the extra heavy reservoir that requires heat to flow. It should be mentioned that cyclic periods can be optimized to reach maximum recovery.

Wellbore

Figure 8A:
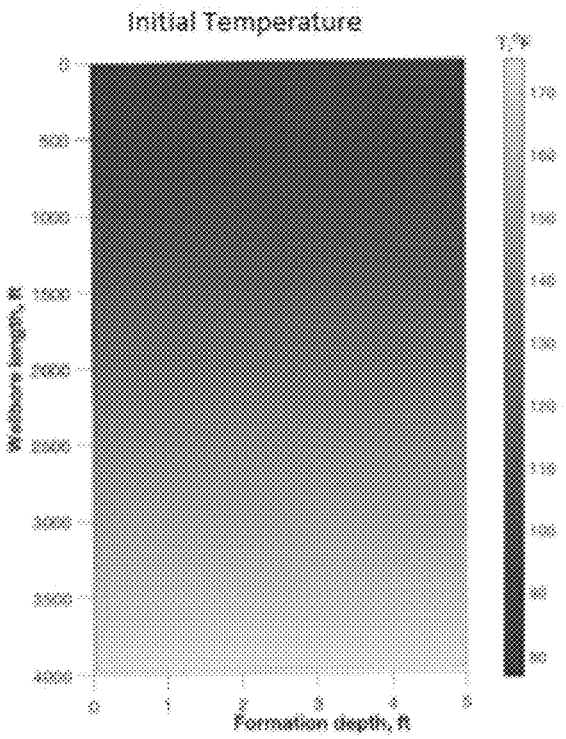
Figure 8B:
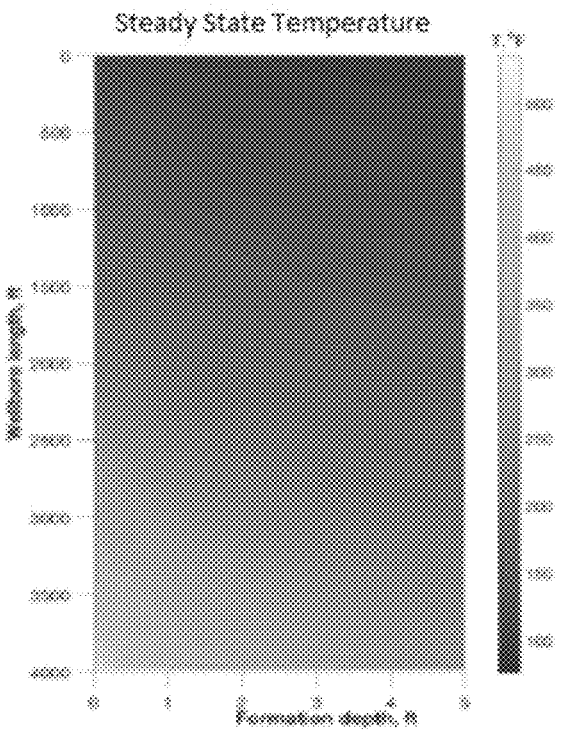

The heating element does not only improve the reservoir fluids' mobility, but can also assist fluid lifting in the wellbore. The model assumes that the initial formation temperature is equal to the geothermal temperature (see FIG. 8A). FIG. 8B shows the formation temperature adjacent to the wellbore after 10 days of production at 50 STB/day. Most of the temperature increase occurred within 1 ft radius around the wellbore; however, the heat flux reached much longer distances due to the no convection condition above the productive zone. Notice that the temperature contour range and colors of FIGS. 8*a* and 8*b* are different. This is due to the high element temperature 536° F. as compared to 176° F. initial reservoir temperature. Also, it is assumed that the 4000 ft represents the section above the heated pay zone.

Figure 9:
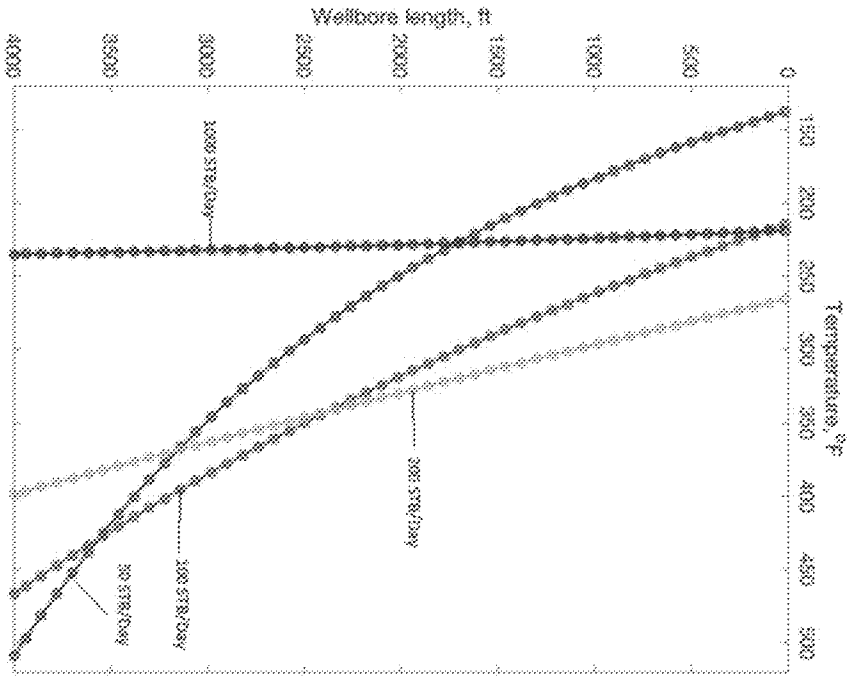
FIG. 9 shows the temperature profile of the wellbore at different flow rates.

The temperature profile in the wellbore also depends on the production rate. FIG. 9 is a continuation of FIG. 4A where the temperature was investigated in the wellbore. Notice that the temperatures at 4000 ft in FIG. 9 is not similar to that at downhole production (zero) location in FIG. 4A. The reason is that the produced fluids from the reservoir were heated again by the element when flowing vertically in the 100 ft heated section. For instance, at 50 STB/day, the produced fluids from the reservoir were at 390° F. (see FIG. 4A) and were heated to 510° F. during the vertical flow around the pay zone (see FIG. 9). Notice that the heated element temperature is assumed to be constant at 536° F. It is observed in FIG. 9 that the fluids are heated to higher temperatures at lower flow rates; nevertheless, they tend to lose temperature faster while flowing to the surface. For the 1000 STB/day case, fluids did not gain temperature as they left the reservoir but heated to 234° F. within the wellbore. Hence, the heating element may not improve the reservoir fluid's mobility but still can improve the outflow performance by reducing density and viscosity.

Figure 10A:
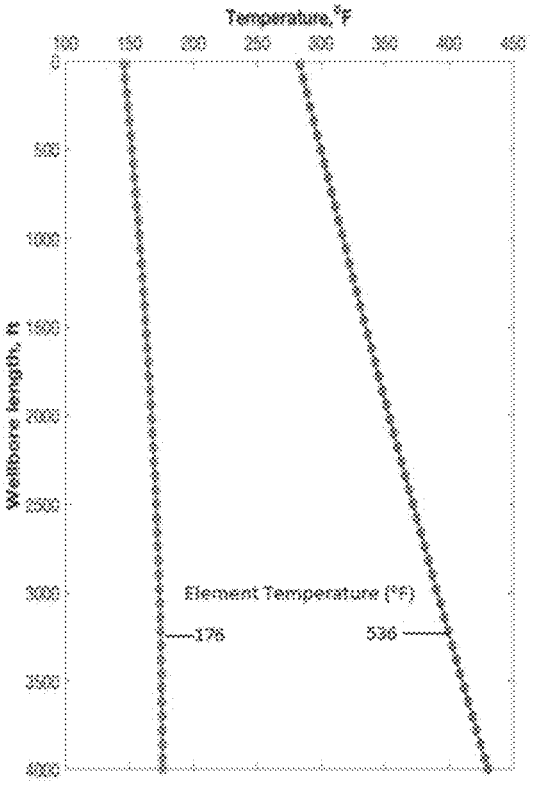
Figure 10B:
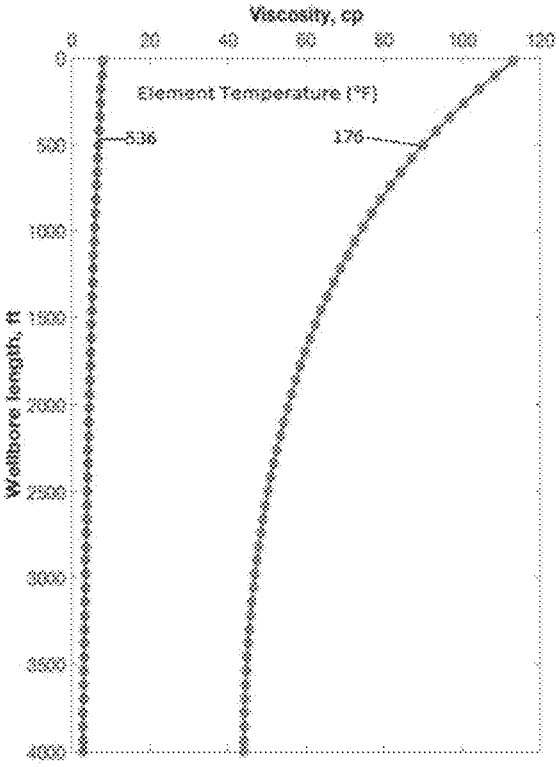
Figure 10C:
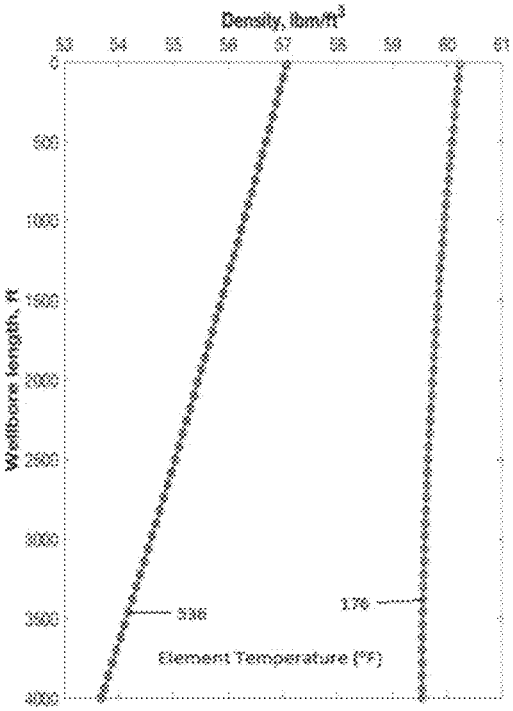

The impact of placing the heating element on wellbore temperature and hence fluid properties are shown in FIG. 10A-10C. It is assumed in this simulation that the heating element temperature was 536° F. and the production rate was 200 STB/day. FIG. 10A shows the shift in the wellbore temperature due to the heating element. FIGS. 10B-10C show the reduction in fluid density and viscosity due to the temperature increase. The reduction in fluid viscosity reduces the pressure drop in the wellbore due to frictional losses while the reduction in fluid density reduces the pressure drop due to the weight of the oil column. This resulted in lower bottomhole pressure for a given production rate.

Figure 11A:
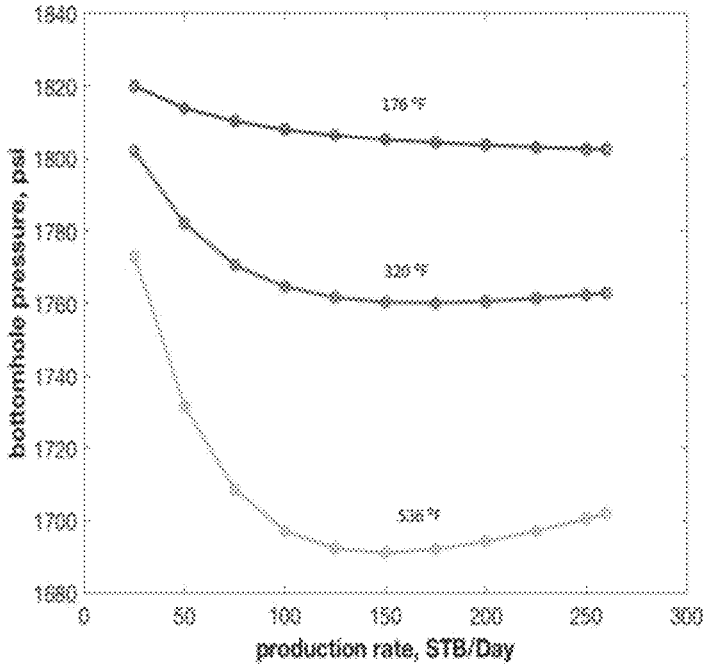
Figure 11B:
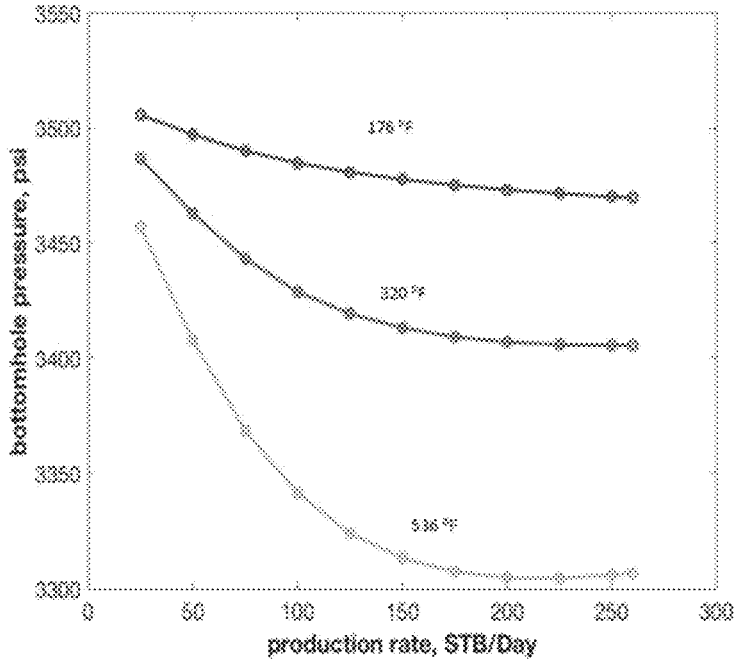

FIG. 11A-11B show the outflow performance relationship (OPR) at different element temperatures. The OPR relates the production rate to the flowing bottomhole pressure in the wellbore. The general trend was a lower flowing bottomhole pressure the element temperature increased (see FIG. 11A). The blue curve in FIG. 11A represents the original case with no heating element. Initially, as the production rate increased, the bottomhole pressure dropped as the wellbore fluids temperatures were higher. For instance, at 100 STB/day, the fluid average temperature in the wellbore is higher than that at 50 STB/day (see FIG. 9). However, at higher flow rates, the pressure increased again as the heating element becomes less efficient and the frictional losses increased. The flow rate range in FIG. 11A-11B did not exceed 260 STB/day as heating became less efficient; hence, a sharp increase in bottom hole pressure will be realized at higher rates. It was noted that the heating element is more efficient in improving oil lifting when the wellbore is longer. For instance, the heating element could reduce the bottomhole pressure by 120 psi when production was 150 STB/day (see FIG. 11A) for the 4000 ft long wellbore case. For the 8000 ft case, a reduction of around 200 psi was achieved (see FIG. 11B); indicating better lifting performance. Also, placing the heating element in a smaller diameter wellbore results in better wellbore performance as compared to larger diameter. The reason is that the temperature increase due to the heating element can significantly reduce the frictional losses which are more severe in smaller diameter wellbores. Also, the lower the API gravity the more efficient the heating element in reducing the flowing bottomhole pressure.

Figure 12A:
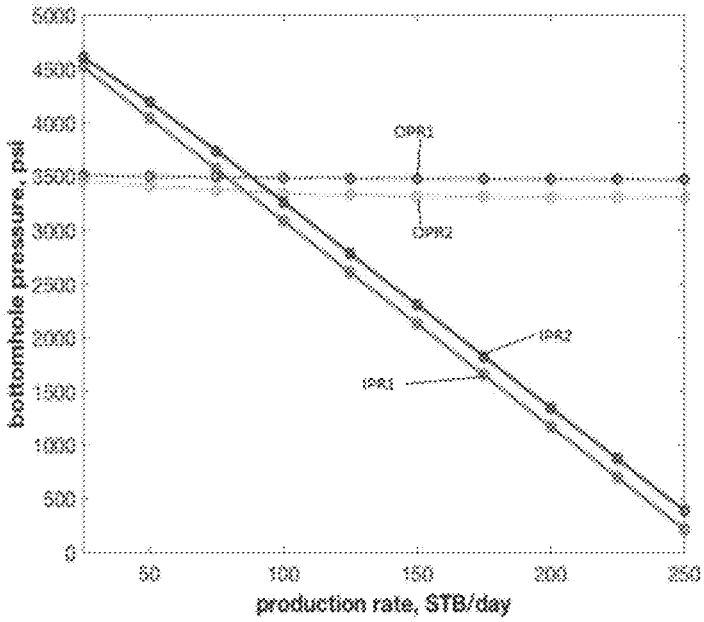
Figure 12B:
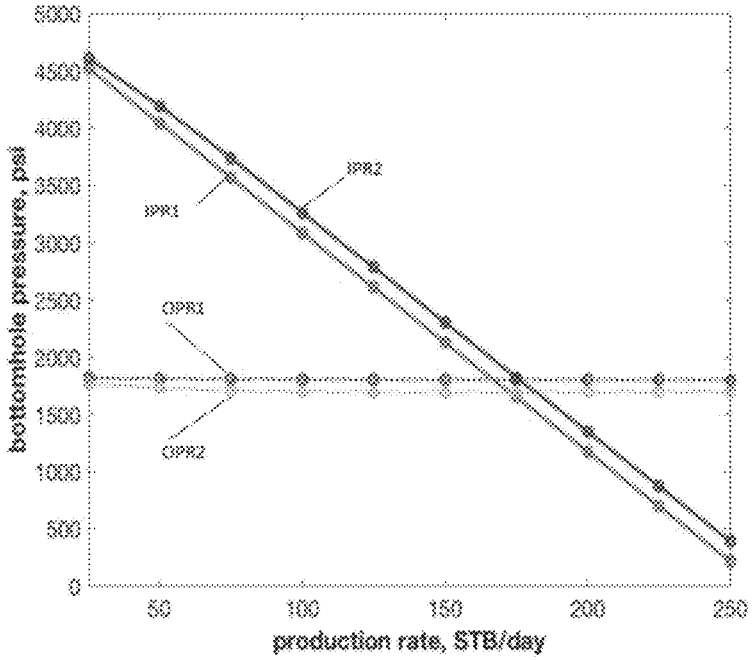

Placing the heating element provides a synergic effect in terms of improving the reservoir fluids mobility and assisting fluids lifting in the wellbore. This can be investigated by studying the reservoir inflow performance relationship (IPR) and wellbore OPR. FIG. 12A-12B shows the OPR in solid lines before (OPR1) and after heating (OPR2) as well as the IPR in dotted lines. The black arrow shows the IPR/OPR intersection before heating with the red one is after heating. The intersection represents the actual reservoir/wellbore system performance. FIG. 12A shows that the production increased from 80 to 96 STB/day representing 20% productivity improving that is attributed to the heating element. FIG. 12B shows that the production rate increased from 162 to 180 STB/day representing only 10% increase in production. Notice that even though the production is higher for the shorter wellbore at a given flowing surface pressure, production increase was lower. In fact, the longer the wellbore, the more viable placing a heating element. Notice that if the vertical left performance in the wellbore is ignored, only half of the production increased will be observed.

Figure 13:
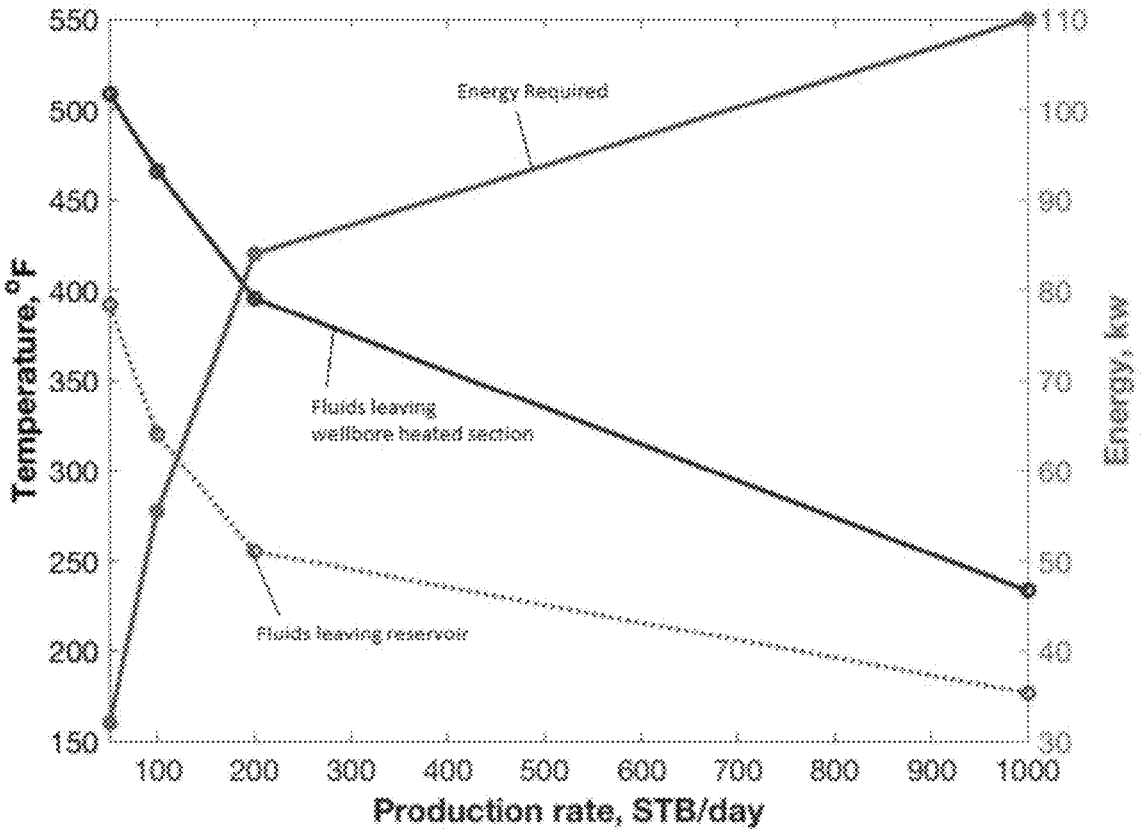
FIG. 13 shows the temperature increase of oil in the oil deposit and leaving the heated portion of the wellbore and the energy usage of the oil heating device.

Finally, it is important to estimate the amount of energy required to keep the heating element temperature constant during production. The energy required at steady state condition can be calculated using the following formula:

$$\dot{E}=\dot{C}_{pl}\dot{m}\Delta T \tag{18}$$

where E is the required energy, $\dot{m}$ is the mass flow rate, and $\Delta T$ is the difference between the temperature of the fluids leaving the heated section of the wellbore and the initial fluid temperature in the reservoir. As discussed, fluids are heated in the reservoir as it flows to the wellbore and heated again as it is vertically flowing within the heated wellbore section. Assuming a heating element temperature of 536° F., FIG. 13 shows the temperature of fluids leaving the reservoir as well as the fluids leaving the heated wellbore section. Also, the figure shows the energy needed to keep the element temperature constant which increases with the increase in production rate. This is logical as more energy needed to keep a material's temperature constant when colder fluid is flowing against it. When the production rate was 200 STB/day, 84 kW was needed to heat the fluids. However, the energy requirement could be 10 times greater for horizontal wellbore. Such energy quantity can be easily supplied during the day utilizing solar cells. Typical solar efficiency in terms of energy generation is around 100 w/m$^2$. In such a scenario, around 840 m$^2$ of solar cells surface area is required when the production rate is 200 STB/day. Even though the heating element approach is not as effective as the steam assisted gravity drainage (SAGD), it requires much lower capital and operational investment. For instance, SAGD requires on average between 15-30 mW [Ali, S. M., & Bayestehparvin, B., 2018, SPE Canada Heavy Oil Technical Conference, Society of Petroleum Engineers] of energy which is at least 20 times the energy required for heated element in 1000 ft horizontal section.

The invention claimed is:

1. A method of enhanced oil recovery, the method comprising:

placing at least two individual, independently-controllable heating elements on a production tubing that is cemented into a wellbore, wherein the heating elements are permanently held in place with a packer inside the production tubing at an oil producing location of a geological formation to form a permanently-installed array of heating elements, heating a portion of the geological formation containing an oil deposit with an oil heating device comprising the permanently-installed array of heating elements at a temperature sufficient to reduce the viscosity of oil in the oil deposit and flow the oil from the oil deposit into the production tubing; and recovering the oil by transporting the oil from the production tubing to the surface;

wherein:

the at least two individual, independently-controllable heating elements are positioned such that the heating elements are aligned opposite one another and in the same position along the length of the production tubing; and the placing, heating, and recovering are free of a step of heating the oil or the geological formation with steam.

2. The method of claim 1, further comprising:

cycling an output state of the oil deposit to a state of not producing, wherein the geological formation is heated while the oil deposit is in the state of not producing, and cycling the output state of the oil deposit to a state of producing.

3. The method of claim 2, wherein the oil is heated while the oil deposit is in the state of not producing for 1 to 100 days.

4. The method of claim 1, wherein the oil heating device further comprises a controller.

5. The method of claim 4, wherein the oil heating device further comprises a plurality of array temperature sensors capable of measuring a temperature profile of the permanently-installed array of heating elements.

6. The method of claim 5, wherein the controller receives input from the plurality of array temperature sensors and adjusts the temperature profile of the permanently-installed array of heating elements based on said input.

7. The method of claim 4, wherein the oil heating device further comprises a plurality of oil temperature sensors capable of measuring a temperature distribution of oil in the production tubing and a plurality of flow sensors capable of measuring an oil flow profile into and along the production tubing.

8. The method of claim 7, wherein the controller receives input from the plurality of oil temperature sensors and the plurality of flow sensors and adjusts the temperature profile of the permanently-installed array of heating elements based on said input.

9. The method of claim 4, wherein the controller adjusts the temperature of the permanently-installed array of heating elements to a defined temperature based on an amount of energy used by the permanently-installed array of heating elements and a production metric of the oil deposit.

10. The method of claim 1, wherein the individual, independently-controllable heating elements are operated to provide the production tubing or the oil deposit a temperature profile that is non-cylindrically symmetrical.

11. The method of claim 1, wherein the individual, independently-controllable heating elements are ohmic heating elements.

12. The method of claim 1, wherein the permanently-installed array of heating elements is heated to a temperature of 400 to 700° F.

13. The method of claim 1, which increases a reservoir productivity index of the oil deposit by 5 to 50% compared to an oil deposit which is not heated.

14. The method of claim 1, wherein a bottomhole pressure required to maintain a production rate of the oil deposit heated according to the method is lowered by 50 to 250 PSI compared to an oil deposit which is not heated.

15. The method of claim 1, wherein the oil deposit in a state of producing produces oil at a rate of 0.05 to 5 STB per day per foot of pay zone thickness.

16. The method of claim 1, wherein the oil heating device uses 25 to 250 kW.

17. The method of claim 1, wherein the oil heating device comprises:

the permanently-installed array of heating elements; and a controller, wherein the permanently-installed array of heating elements comprises at least two individual, independently-controllable heating elements controlled by the controller.

18. The method of claim 17, wherein the at least two individual, independently-controllable heating elements are capable of giving the permanently-installed array a temperature profile that is non-cylindrically symmetrical.

19. The method of claim 17, wherein the permanently-installed array of heating elements is capable of being heated to a temperature of 400 to 700° F.

20. The method of claim 17, wherein the oil heating device further comprises a plurality of sensors connected to the controller, the sensors being at least one selected from the group consisting of array temperature sensors, oil temperature sensors, and oil flow sensors.

* * * * *